US007954182B2

(12) United States Patent
Habegger

(10) Patent No.: US 7,954,182 B2
(45) Date of Patent: Jun. 7, 2011

(54) REMOVABLE WATERTIGHT BATHTUB WALL

(76) Inventor: Virgile Habegger, Savigny (CH)

( * ) Notice: Subject to any disclaimer, the term of this patent is extended or adjusted under 35 U.S.C. 154(b) by 1163 days.

(21) Appl. No.: 11/439,939

(22) Filed: May 24, 2006

(65) Prior Publication Data

US 2006/0277677 A1 Dec. 14, 2006

(30) Foreign Application Priority Data

Jun. 8, 2005 (FR) ..... 05 05815

(51) Int. Cl.
*A47K 3/022* (2006.01)
*A47K 4/00* (2006.01)

(52) U.S. Cl. ..... 4/596; 4/662; 4/665

(58) Field of Classification Search ..... 4/662–665, 4/596

See application file for complete search history.

(56) References Cited

U.S. PATENT DOCUMENTS 3,869,732 A * 3/1975 Garvey et al. ..... 4/662
4,089,073 A * 5/1978 Campbell ..... 4/665
4,118,810 A 10/1978 Brickhouse
4,881,284 A * 11/1989 Garvey ..... 4/662
4,922,559 A * 5/1990 Wall ..... 4/662

FOREIGN PATENT DOCUMENTS

| | | | |
|---|---|---|---|
| DE | 19503514 | A1 * | 8/1995 |
| DE | 19651451 | A1 * | 5/1997 |
| DE | 196767 | | 5/1998 |
| DE | 19647767 | A1 * | 5/1998 |
| FR | 2847788 | | 6/2004 |
| WO | WO 02/00082 | | 1/2002 |
| WO | WO 2004/034863 | | 4/2004 |

* cited by examiner

*Primary Examiner* — Khoa D Huynh

(74) *Attorney, Agent, or Firm* — Sturm & Fix LLP

(57) ABSTRACT

Washroom designed for taking a shower which comprises a water intake and a drain for wastewater, and includes an accessory representing a removable bathtub wall. A mechanism is provided for locking and for pressing on the outer surface of the accessory when in a bathtub wall configuration to ensure that it is strong and watertight. The locking mechanism is an element which takes up a horizontal position on the floor in a shower configuration of the washroom, and a substantially vertical position in a bathtub configuration.

8 Claims, 4 Drawing Sheets

REMOVABLE WATERTIGHT BATHTUB WALL

CROSS REFERENCE TO RELATED APPLICATIONS

This application claims priority of French Application No. 05 05815 filed Jun. 8, 2005, which is incorporated by reference herein in its entirety.

BACKGROUND OF THE INVENTION

The invention relates to a particular kind of washroom which we will call a bath/shower due to its ability to change from a shower into a bathtub and vice versa.

DESCRIPTION OF THE PRIOR ART

The applicant's document WO 2004/034863 describes a sanitary installation comprising a washroom having an auxiliary element which can be used either as a bench in a shower configuration or as a water retention wall in a bathtub configuration. One problem with this solution relates to ensuring that this removable bathtub wall is watertight and can withstand the pressure of the water and the weight of a user who may lean on this wall.

SUMMARY OF THE INVENTION

The aim of the present invention is to propose a device that can change from a shower into a bath which ensures that the bathtub obtained is fully watertight, strong and stable.

The invention achieves the above aims with a washroom designed for taking a shower which comprises a water intake and a drain for wastewater, an accessory representing a removable bathtub wall, this washroom comprising a means for locking and for pressing on the outer surface of the accessory when in a bathtub wall configuration to ensure that it is strong and watertight.

According to one embodiment, the locking means is an element which takes up a horizontal position on the floor in a shower configuration of the washroom and a substantially vertical position in a bathtub configuration. It may be a grate placed over a wastewater drainpipe in the shower configuration, which can rotate about a pin to take up a substantially vertical position in the bath configuration.

According to an alternative embodiment, a second grate may be placed under the movable grate. This second grate may be permanently in a horizontal position in a housing in the upper part of the pipe, underneath the position of the first grate in the shower configuration, or it may also be able to rotate about the same pin and be perpendicular to the first grate so as to take up a horizontal position over the pipe when in the bath configuration.

The means for locking and for pressing on the outer surface of the accessory may take up a surface area equal to at least one third of the outer surface of the accessory.

It may be rotatable and actuated using a manual lever, which may take up two stable locked positions, corresponding to the substantially horizontal and vertical positions of said locking and pressing means.

It may also take up a stable intermediate position, to facilitate the change from shower to bath.

Lastly, it may consist of a rigid frame surrounded by an elastically deformable flexible part.

DESCRIPTION OF THE DRAWINGS

These aims, features and advantages of the present invention will be explained in detail in the following description of a particular embodiment provided by way of non-limiting example in relation to the attached figures, in which.

DESCRIPTION OF THE PREFERRED EMBODIMENTS

Figure 1:
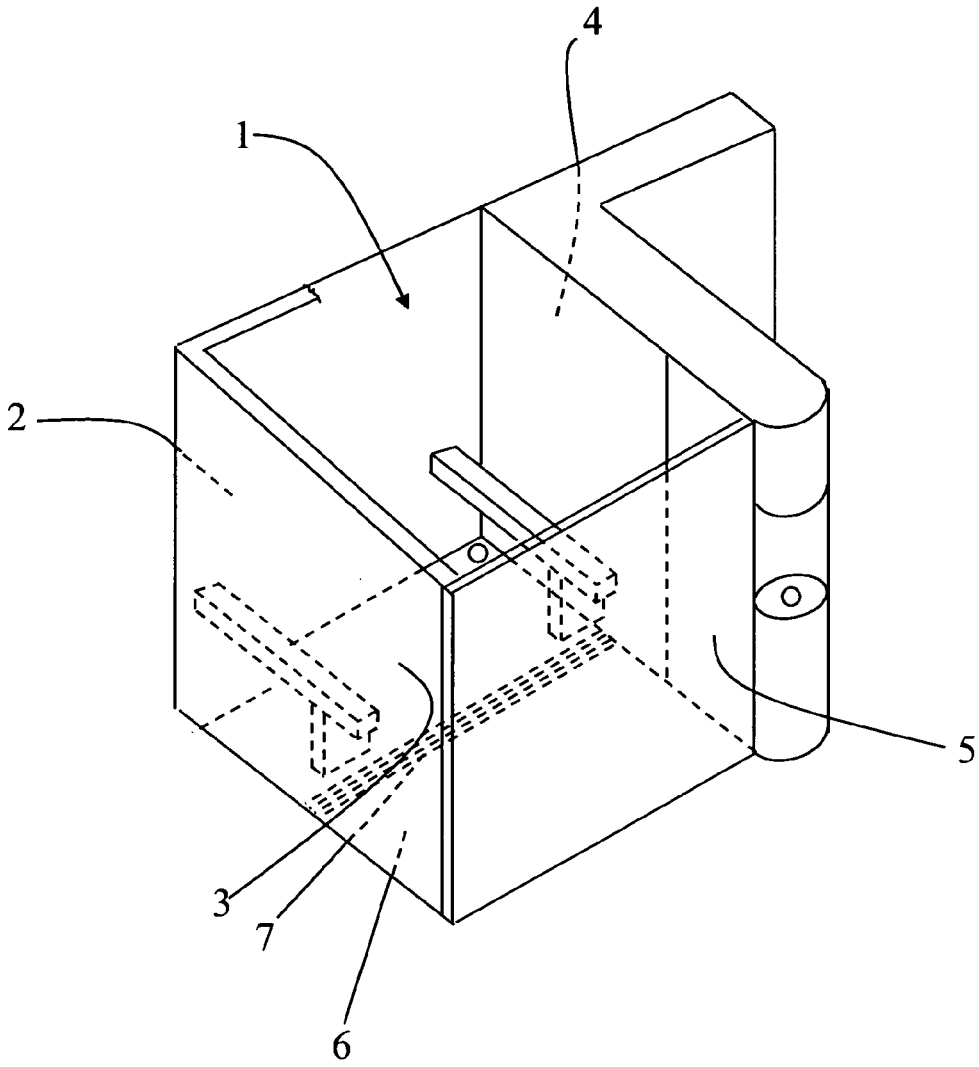
FIG. 1 shows a washroom according to an embodiment of the invention.

FIG. 1 shows an embodiment of a washroom 1 according to the invention, having a geometry similar to an embodiment as described in the prior art document WO 2004/034863 but with a device according to the invention.

In FIG. 1, this washroom is in the shower position. It is delimited by four side walls 2, 3, 4, 5. Its floor 6 is relatively flat, possibly sloping slightly toward a substantially central grate 7 for draining off wastewater. For the sake of simplification, the water intake device is not shown.

Figure 2:
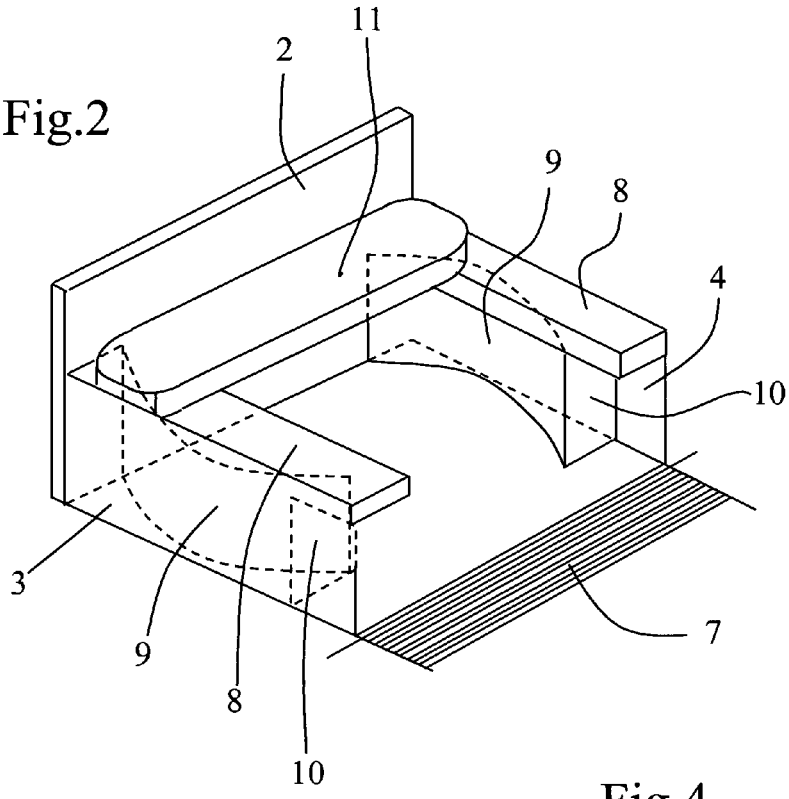
FIG. 2 shows an enlarged perspective view of the bath/shower of FIG. 1.

As is shown more clearly in FIG. 2, the washroom has two lateral consoles 8 positioned against the respective walls 3, 4 of the washroom and supported by vertical support elements 9 having a concave surface facing the inside of the washroom. These vertical supports have a length of around 70 cm, shorter than that of the consoles 8 which are around 90 cm long, are positioned against the wall 2 of the washroom and end in a vertical wall 10 which is set back from the end of the consoles 8 by a distance of around 20 cm, corresponding to the thickness of an accessory 11, for reasons which will become clear below. This accessory 11 is arranged horizontally and transversely to the washroom, between the side walls 3, 4, resting on the consoles 8 on either side. In this shower position, this accessory 11 thus serves as a bench, the consoles possibly being used as shelves for holding toilet preparations, or even as auxiliary benches.

Figure 3:
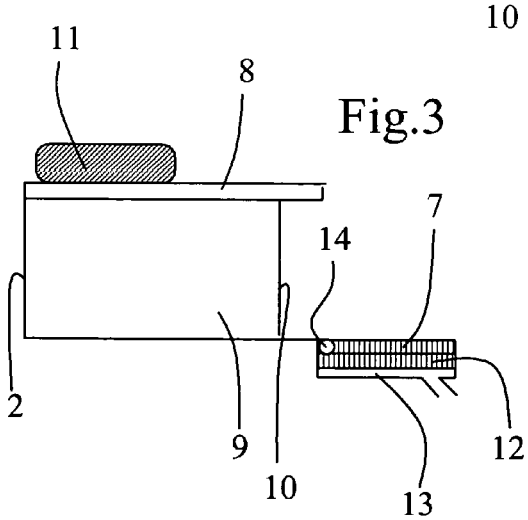
FIG. 3 shows a side view of the bath/shower according to an embodiment of the invention in the shower position.

FIG. 3 shows the same elements from the side, in the shower position. It can be seen that the water drainpipe 13 is closed off by two superposed grates 7 and 12, the grate 7 being rotatable about a pin 14 and the grate 12 being fixed.

Figure 4:
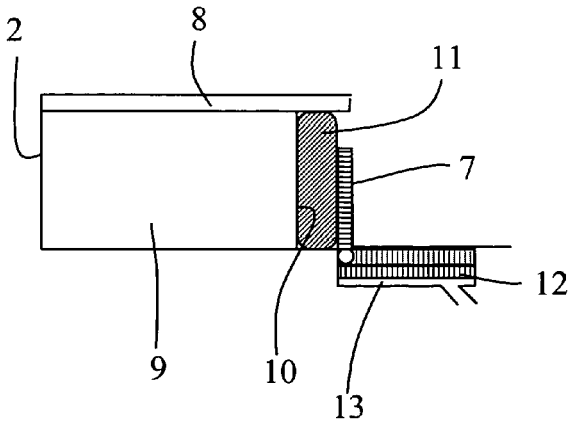
FIG. 4 shows a side view of the bath/shower according to an embodiment of the invention in the bath position.

FIG. 4 shows the washroom after the change from shower to bath. The bathtub consists of the wall 2 of the washroom, the two curved surfaces of the support elements 9 of the consoles 8 and the accessory 11 positioned vertically on its edge to form the missing fourth wall or barrier wall of the bathtub. It thus uses three permanent walls plus one removable wall, the accessory 11, which we will call the bench/bath in reference to its two functions. For the sake of simplification, the water intake(s) and the hose(s) used for the shower and/or bath functions are not shown.

To ensure that the bathtub thus formed is watertight and strong, the top grate 7 which covers the drainpipe 13 takes up a second, almost vertical position in this bath configuration in which the bench/bath 11 is sandwiched between the vertical walls 10 and the grate 7. Advantageously, the grate 7 exerts pressure all along the outer surface of the bench/bath 11, thus ensuring it can withstand the pressure of the water in the bath and any other pressure exerted by a user, for example. The permanent grate 12 then alone covers the pipe 13.

The width of the bench 11 corresponds to the height of the overflow in a standard bathtub, between 30 and 40 cm for example, and is housed underneath and bearing against the surface of the consoles 8 of corresponding height. Its length corresponds to the width of the washroom 1 and to the length of a standard bathtub, i.e. around 1.5 m. Lastly, its thickness is around 20 cm, which corresponds approximately to the distance between the grate 7 when raised and the surface 10, and to the length of the console 8 which projects beyond its support element 9.

Figure 5:
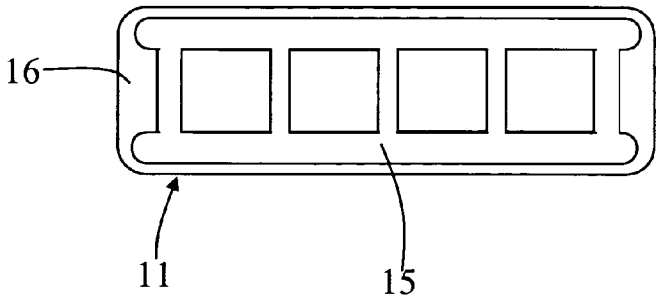
FIG. 5 shows the structure of a removable bath wall according to an embodiment of the invention.
Figure 6:
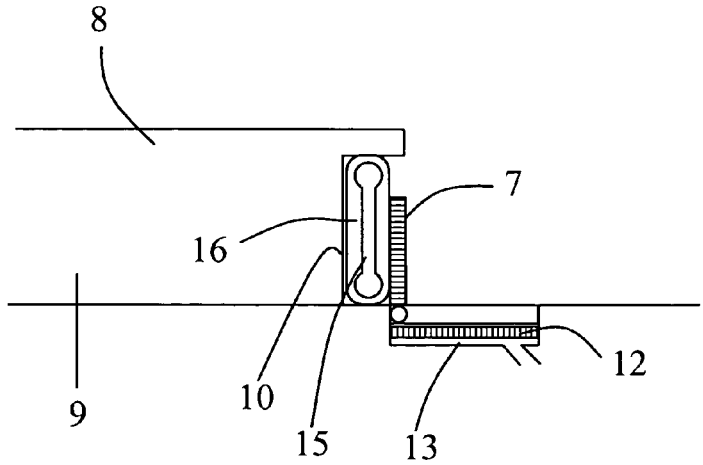
FIG. 6 shows a side view of this structure in the bath position.

FIG. 5 shows a possible structure of the bench/bath 11, which may comprise a rigid framework 15 in the shape of a ladder surrounded by a more flexible, elastically deformable material 16 such as a foam. The nominal dimensions of the bench/bath are slightly greater than its housing provided for in the bath configuration: thus, in this configuration, it is compressed in all three dimensions, height, length and width, this being possible thanks to the foam 16 which surrounds it. This compression further improves the watertightness of this removable wall.

The fact that the water drainpipe 13 is located on the outer edge of the removable wall of the bathtub is advantageous since it makes it possible to immediately drain off any water that leaks from the bathtub, and to drain off water that drips off a user when he or she gets out of the bath. The auxiliary wall 11 of the bathtub thus fulfills an additional overflow function, since it makes it possible to drain off water in the event of filling to a level above its height.

Figure 7A:
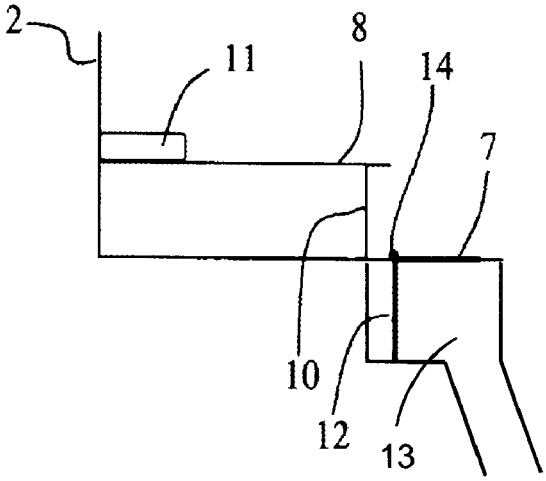
FIG. 7*a* to 7*d* show the main steps in the change of the bath/shower from the shower position to the bath position.
Figure 7B:
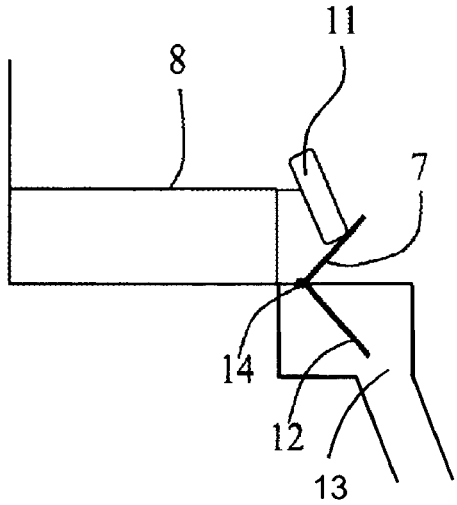
Figure 7C:
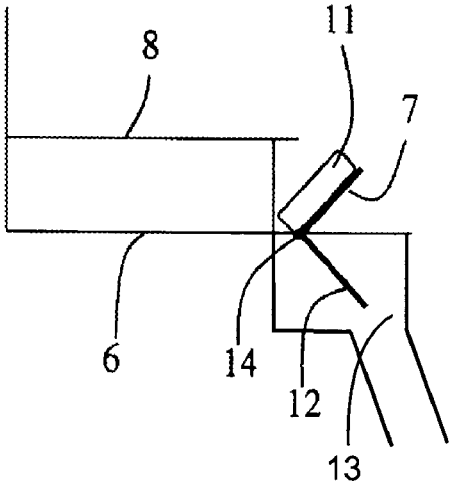
Figure 7D:
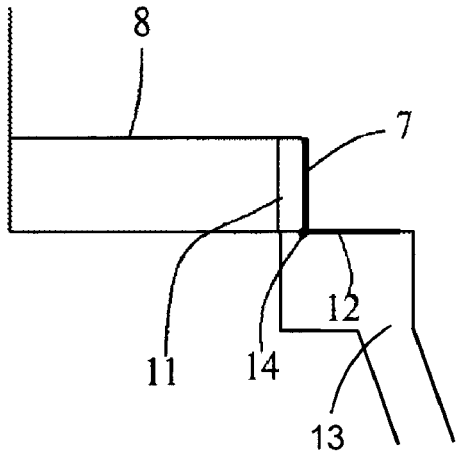

FIGS. 7*a* to 7*d* schematically show the essential steps in performing the change from shower to bath. In FIG. 7*a*, the washroom is in the shower configuration. According to an alternative embodiment as shown in these figures, the drainpipe is covered by a first grate 7 connected to a second perpendicular grate 12, positioned vertically inside the pipe in this configuration. The bench/bath 11 is slid as far as the ends of the consoles 8 and then tilted. At the same time, the grate 7 is pivoted about its pin 14 and holds a first end of the bench/bath 11 which bears on it in the tilted position, while the second end rests on the consoles 8. The bench/bath 11 is pushed off the consoles 8 completely. It then slides to the floor 6 on the inclined slope formed by the grate 7 in its intermediate position, taking up the intermediate position of FIG. 7*c*. Lastly, the grate 7 completes its rotation into the vertical position, simultaneously causing the bench/bath to move into its bathtub wall configuration of FIG. 7*d*. At the same time, the second grate 12, which is perpendicular to the grate 7, also rotates by a quarter of a turn about the pin 14 and takes up a horizontal position, over the pipe 13. The change from bath to shower is performed with a reversible movement comprising the above steps in reverse order.

There are various possible ways of rotating the grate. For example, a manual lever connected to the pin 14 and to the grate 7 may be provided along a side wall 3 or 4 of the washroom. A means for locking the grate 7 in the vertical position must also be provided, for example in the form of a hook for locking the actuating lever. Optionally, the grate may be locked in an intermediate position such as that shown in FIG. 7*b*. Alternatively, a motorized means may be provided to cause these movements.

According to one alternative embodiment, the accessory 11 forming the removable wall 11 of the bath may possibly not be a bench, and not used in the shower configuration, but simply stowed away appropriately.

Moreover, the rotatable grate 7 may be replaced by any other means of similar shape, which may take up a vertical position allowing it to fulfill the function of locking and pressing on a large surface area of the accessory 11 so as to oppose the pressure of the water in the bath, to ensure the removable wall is strong and the bath is watertight. It may be a strip placed on the floor of the shower, not necessarily rectangular in shape, which does not take up the whole length of the bathtub.

The same inventive concept may be used with more than one removable bathtub wall.

The solution thus makes it possible to use a washroom to take a conventional shower, accessing it without having to climb over any obstacles. It also makes it possible to take a bath, of standard dimensions, after a simple changeover.

The removable barrier wall of the bathtub, placed in the bathtub wall position according to the invention, thus guarantees watertightness, and ensures this wall is strong and can withstand impacts. Moreover, this a hygienic, self-cleaning solution.

The invention claimed is:

1. A washroom designed to be changeable between a shower configuration and a bathtub configuration, the washroom including a floor, a water intake and a wastewater drainpipe, the washroom comprising:

a removable bathtub wall accessory which is removed when the washroom is in the shower configuration and which forms a bathtub wall and has an outer surface oriented outside the bath when the washroom is in the bathtub configuration;

a panel pivotally attached to the floor, the panel being disposed to press on the outer surface of the accessory when in the bathtub configuration, and wherein the panel takes up a horizontal position on the floor when in the shower configuration of the washroom, and the panel takes up a substantially vertical position disposed outside of the bathtub when in the bathtub configuration.

2. The washroom as claimed in claim 1, wherein the panel is a first grate disposed over a wastewater drainpipe when in the shower configuration, which is rotatable about a pin to take up a substantially vertical position when in the bathtub configuration.

3. The washroom as claimed in claim 2, which comprises a second grate under the first grate which is disposed over the wastewater drainpipe in the shower configuration.

4. The washroom as claimed in claim 3, wherein the second grate is permanently in a horizontal position in a housing in an upper part of the wastewater drainpipe, underneath a position of the first grate when in the shower configuration.

5. The washroom as claimed in claim 1, wherein the panel takes up a surface area equal to at least one third of the outer surface of the accessory.

6. The washroom as claimed in claim 5, wherein the panel also takes up a stable intermediate position, to facilitate the change from the shower configuration to the bathtub configuration.

7. The washroom as claimed in claim 1, wherein the accessory consists of a rigid frame surrounded by an elastically deformable flexible part.

8. The washroom as claimed in claim 3, wherein the second grate moves between a horizontal position in a housing in an upper part of the wastewater drainpipe when the washroom is in the bathtub configuration, and a vertical position in the upper part of the wastewater drainpipe when the washroom is in the shower configuration.

* * * * *